US011408246B2

(12) United States Patent
Connor

(10) Patent No.: US 11,408,246 B2
(45) Date of Patent: Aug. 9, 2022

(54) EXPANSION SYSTEM USABLE WITH SHOELESS EXPANDABLE TUBULAR

(71) Applicant: Enventure Global Technology, Inc., Houston, TX (US)

(72) Inventor: Eric Connor, Katy, TX (US)

(73) Assignee: Enventure Global Technology, Inc.

( * ) Notice: Subject to any disclaimer, the term of this patent is extended or adjusted under 35 U.S.C. 154(b) by 54 days.

(21) Appl. No.: 16/861,538

(22) Filed: Apr. 29, 2020

(65) Prior Publication Data

US 2020/0355039 A1 Nov. 12, 2020

Related U.S. Application Data

(60) Provisional application No. 62/844,993, filed on May 8, 2019.

(51) Int. Cl.

| | |
|---|---|
| ***E21B 33/128*** | (2006.01) |
| ***E21B 23/04*** | (2006.01) |
| ***E21B 43/10*** | (2006.01) |

(52) U.S. Cl.

CPC ..... *E21B 33/1285* (2013.01); *E21B 23/0422* (2020.05); *E21B 43/105* (2013.01); *E21B 2200/04* (2020.05)

(58) Field of Classification Search

CPC ..... E21B 33/1285; E21B 43/105; E21B 23/0422; E21B 2200/04; E21B 43/106

See application file for complete search history.

(56) References Cited

U.S. PATENT DOCUMENTS

| | | | | |
|---|---|---|---|---|
| 5,927,403 | A * | 7/1999 | Dallas | E21B 33/068 166/77.51 |
| 6,892,819 | B2 | 5/2005 | Cook et al. | |
| 7,240,729 | B2 | 7/2007 | Cook et al. | |
| 7,779,923 | B2 * | 8/2010 | Holland | E21B 23/01 166/380 |
| 8,439,107 | B2 * | 5/2013 | Xu | E21B 23/00 166/125 |
| 8,684,096 | B2 * | 4/2014 | Harris | E21B 23/04 166/382 |

(Continued)

OTHER PUBLICATIONS

GCC Patent Office, Examination report issued in corresponding application serial No. GC 2020-39696 dated Oct. 26, 2021, 4 pages.

*Primary Examiner* — Jonathan Malikasim

(74) *Attorney, Agent, or Firm* — Jonathan Pierce; Pierre Campanac; Porter Hedges LLP

(57) ABSTRACT

An expansion system is capable of expanding a tubular that has no shoe or plug. The tubular is expanded by a cone coupled to a mandrel, which is energized by a jack actuator to effect a plurality of strokes. The jack actuator is supported by a support member. The jack actuator releasably engages and locks to an operational pipe at predetermined length intervals corresponding to the length of each actuator stroke. The actuator jack is reset and moved to a new locking location between strokes. The operational pipe holds the expandable tubular in place during expansion. After expansion, the cone, mandrel, actuator jack, and operational pipe are free of the expandable tubular and can be pulled out of the wellbore. The expansion system can be used for applications of patches having a small size in wellbores where milling debris may be detrimental.

18 Claims, 6 Drawing Sheets

(56) References Cited

U.S. PATENT DOCUMENTS

| | | | | |
|---|---|---|---|---|
| 9,624,727 | B1 * | 4/2017 | Hutton | E21B 7/067 |
| 9,702,229 | B2 * | 7/2017 | Zhou | E21B 43/105 |
| 9,803,440 | B2 * | 10/2017 | Eldho | E21B 23/00 |
| 10,760,363 | B2 * | 9/2020 | Tom | E21B 23/01 |
| 2018/0299234 | A1 * | 10/2018 | Baum | F42B 1/036 |

* cited by examiner

EXPANSION SYSTEM USABLE WITH SHOELESS EXPANDABLE TUBULAR

CROSS-REFERENCE TO RELATED APPLICATIONS

This application claims the benefit of priority to U.S. provisional application Ser. No. 62/844,993 filed on May 8, 2019, which is incorporated herein by reference in its entirety for any and all purposes.

BACKGROUND

This disclosure relates generally to methods and apparatus for expanding a tubular in a wellbore.

In known expandable systems, the expandable tubular is provided with a shoe or plug at the bottom. The shoe or plug is provided to seal a lower portion of the expandable tubular so that fluid pressure can be increased in the lower portion. The fluid pressure is, in turn, utilized to assist an expansion system with the vertical movement of an expansion cone along the length of the expandable tubular. After the expansion of the expandable tubular, operators drill out the shoe in a separate trip. The drill out of the shoe often generates debris into the wellbore.

In other known expandable systems, the expandable tubular can be shoeless. The expansion of the expandable tubular may rely on a jack-style actuator used repeatedly to expand portions of the expandable tubular sequentially, for example, as shown in U.S. Pat. No. 7,240,729. However, with these expansion systems, it can be difficult to lock the jack-style actuator on the usually smooth bore of the expandable tubular.

There is a continuing need in the art for methods and apparatus for expanding a tubular in a wellbore that are capable of expanding a shoeless tubular.

BRIEF SUMMARY OF THE DISCLOSURE

The disclosure describes an expansion system that may be used for expanding an expandable tubular. The expandable tubular may not have a shoe or plug.

The expansion system may comprise an operational pipe. The operational pipe may include a plurality of sections. The operational pipe may include a releasable latch located at the bottom of the operational pipe and coupled to the expandable tubular. The operational pipe may include a cap. The cap may have a shoulder.

The expansion system may comprise an actuator. The actuator may be modular. The actuator may include a plurality of stages. The actuator may include a bottom shoulder capable of catching the shoulder of the cap.

The expansion system may comprise a mandrel and cone assembly. The mandrel and cone assembly may include a plurality of extensions. The mandrel and cone assembly may include enlarged portions or buckling arrestors on each of the plurality of extensions. The enlarged portions or buckling arrestors may be sized to extend the releasable latch radially and prevent the releasable latch from decoupling from the expandable tubular. The mandrel and cone assembly may include an unsupported section above a cone. The unsupported section may be sized to allow the releasable latch to contract radially and decouple from the expandable tubular.

The expansion system may comprise a unidirectional locking mechanism. The unidirectional locking mechanism may be stationary relative to one of the actuator or the operational pipe and unidirectionally movable relative to the other of the actuator and the operational pipe. For example, the unidirectional locking mechanism includes a split-ring ratcheting lock configured to releasably engage and unidirectionally lock to inner threads on the plurality of sections of the operational pipe. Alternatively, the unidirectional locking mechanism includes a split-ring ratcheting lock configured to releasably engage and unidirectionally lock to outer threads on a housing of the actuator or extension collars mounted on the actuator.

The disclosure also describes a method for expanding an expandable tubular.

The method may comprise the step of measuring a length an expandable tubular. The method may comprise the step of determining a first number of sections to form an operational pipe based on the measured length. The method may comprise the step of determining a second number of extensions to form a mandrel and cone assembly based on the measured length. The method may comprise the step of determining a force magnitude to expand the expandable tubular and a fluid pressure to expand the expandable tubular. The method may comprise the step of determining a third number of stages to achieve the force magnitude with the fluid pressure.

The method may comprise the step of assembling an expansion system as described hereinabove. For example, the expansion system may include an operational pipe formed with the first number of sections, a mandrel and cone assembly formed with the second number of extensions, an actuator formed with the third number of stages, and a unidirectional locking mechanism.

The method may comprise the step of expanding the expandable tubular. Expanding the expandable tubular may comprise the repeated steps of stroking the actuator. For example, the unidirectional locking mechanism may be engaged to the operational pipe during a stroke of the actuator; and the unidirectional locking mechanism may move relative to the operational pipe during a reverse stroke of the actuator. Expanding the expandable tubular may further comprise extending a releasable latch with enlarged portions or buckling arrestors to prevent the releasable latch from decoupling from the expandable tubular.

The method may comprise the step of contracting the releasable latch within an unsupported section to allow the releasable latch to decouple from the expandable tubular. The method may comprise the step of catching a cap of the operational member with a bottom shoulder of the actuator to hang the operational pipe from the actuator.

BRIEF DESCRIPTION OF THE DRAWINGS

For a more detailed description of the embodiments of the disclosure, reference will now be made to the accompanying drawings, wherein.

For the sake of simplicity, the appended Figures have not been drawn to scale.

DETAILED DESCRIPTION

Figure 1:
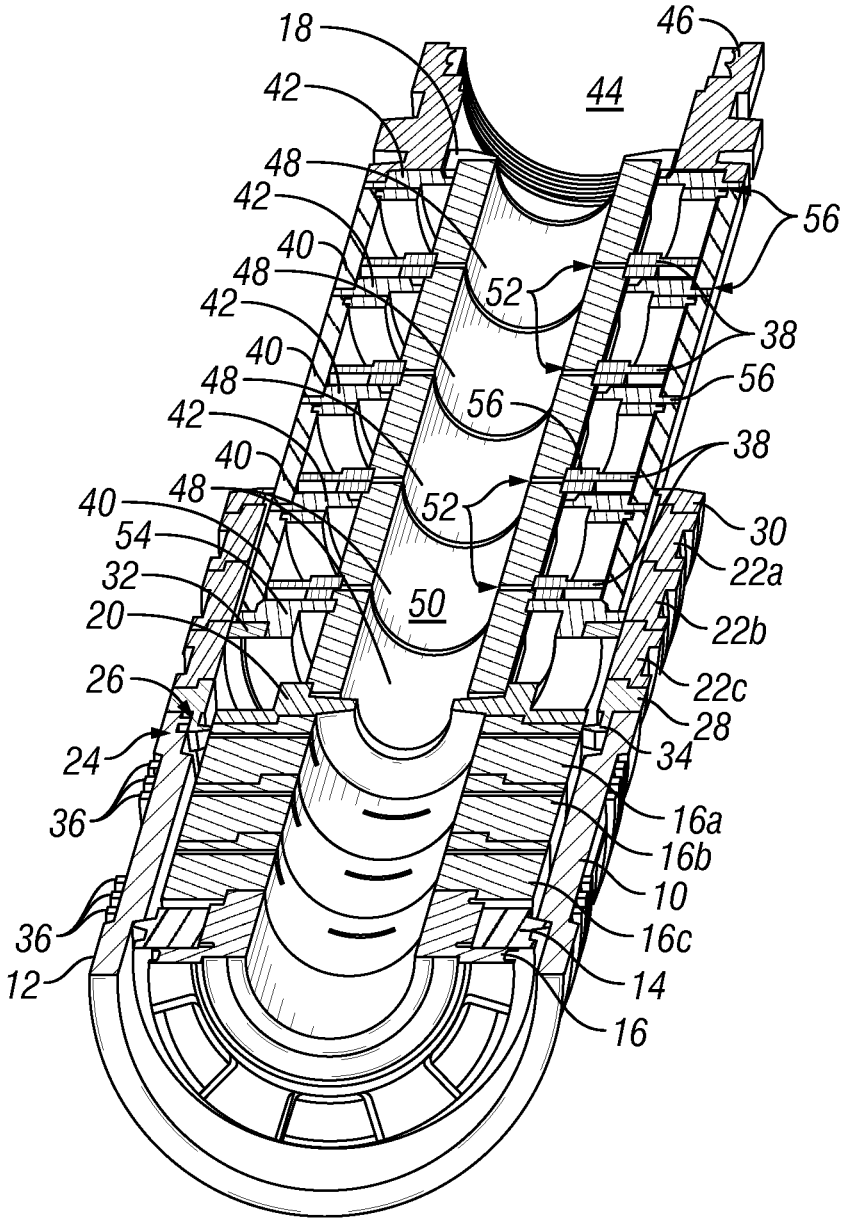
FIG. 1 is a sectioned perspective view of an expansion system illustrated in a pick-up and run-in-hole position.

FIG. 1 illustrates an expansion system that is used for expanding an expandable tubular 10. For example, the expandable tubular 10 may be used as a patch for repairing a wellbore casing or in an open hole. In operation, the expansion system is lowered in the wellbore using a support pipe (not shown).

The expansion system comprises a jack actuator. In operation, the jack actuator is connected to a lower end of the support pipe. The jack actuator is preferably a multi-stage hydraulic jack. The jack actuator is preferably modular so that stages can be added to reduce the pressure needed to exert a given force, or can be removed to shorten the jack actuator. In the example shown, the jack actuator has four stages. The jack actuator comprises a housing assembly and a piston assembly, which moves relative to the housing assembly.

In an embodiment, the housing assembly of the jack actuator includes four piston housings 40, four piston sleeves 42, and one bottom piston sleeve 54. Four chambers are formed by connecting one of the piston housings 40 between two consecutive sleeves of the piston sleeves 42 or the bottom piston sleeve 54. Each of the four piston sleeves 42 includes an outer passageway 56 between the wellbore and an upper portion of one of the chambers. The housing assembly may also include a safety joint 46, which may be connected to the uppermost of the four piston sleeves 42. The safety joint 46 may be used to connect the jack actuator to the support pipe.

The piston assembly of the jack actuator includes five piston rods 48 and four pistons 38. Each of the four pistons 38 is located in one of the four chambers. A continuous bore 50 is formed by connecting each of the four pistons 38 between two consecutive rods of the five piston rods 48. The space between any two consecutive rods of the five piston rods 48 forms a portion of an inner passageway 52 from the continuous bore 50. Each of the inner passageways 52 extends through the piston rods 48 into a lower portion of the chambers. Thus, each inner passageway 52 provides a fluid communication between the continuous bore 50 and the lower portion of one of the chambers. The continuous bore 50 is in fluid communication with a bore in the support pipe through a bore 44 in the safety joint 46. A ball entry guide 18 may be connected to the uppermost of the five piston rods 48. A ball seat or crossover 20 may be connected to the lowermost of the five piston rods 48. The piston assembly of the jack actuator seals against the housing assembly of the jack actuator (i.e., the piston sleeves 42, the bottom piston sleeve 54, and the piston housings 40).

By way of example, one stage can be removed from the jack actuator by removing one piston sleeve 42 and one piston housing 40 located between the safety joint 46 and the bottom piston sleeve 54 from the housing assembly of the jack actuator, and by removing one piston rod 48 and one piston 38 located between the ball entry guide 18 the ball seat or crossover 20 from the piston assembly of the jack actuator. Conversely, one stage can be added to the jack actuator by adding, between the ball entry guide 18 the ball seat or crossover 20, one piston 38 and one piston rod 48 to the piston assembly of the jack actuator, and by adding, between the safety joint 46 and the bottom piston sleeve 54, one piston housing 40 and one piston sleeve 42 to the housing assembly of the jack actuator.

Figure 2:
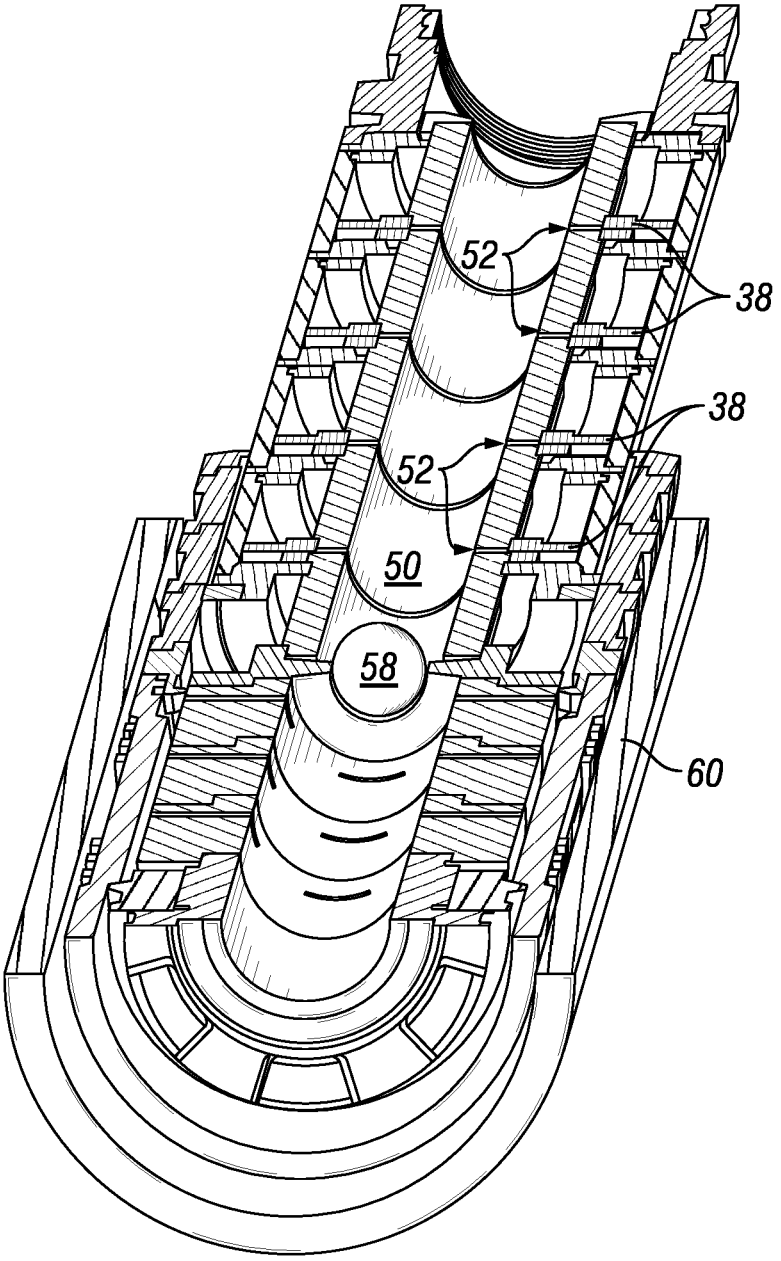
FIG. 2 is a sectioned perspective view of the expansion system shown in FIG. 1, illustrated positioned in a wellbore.
Figure 3:
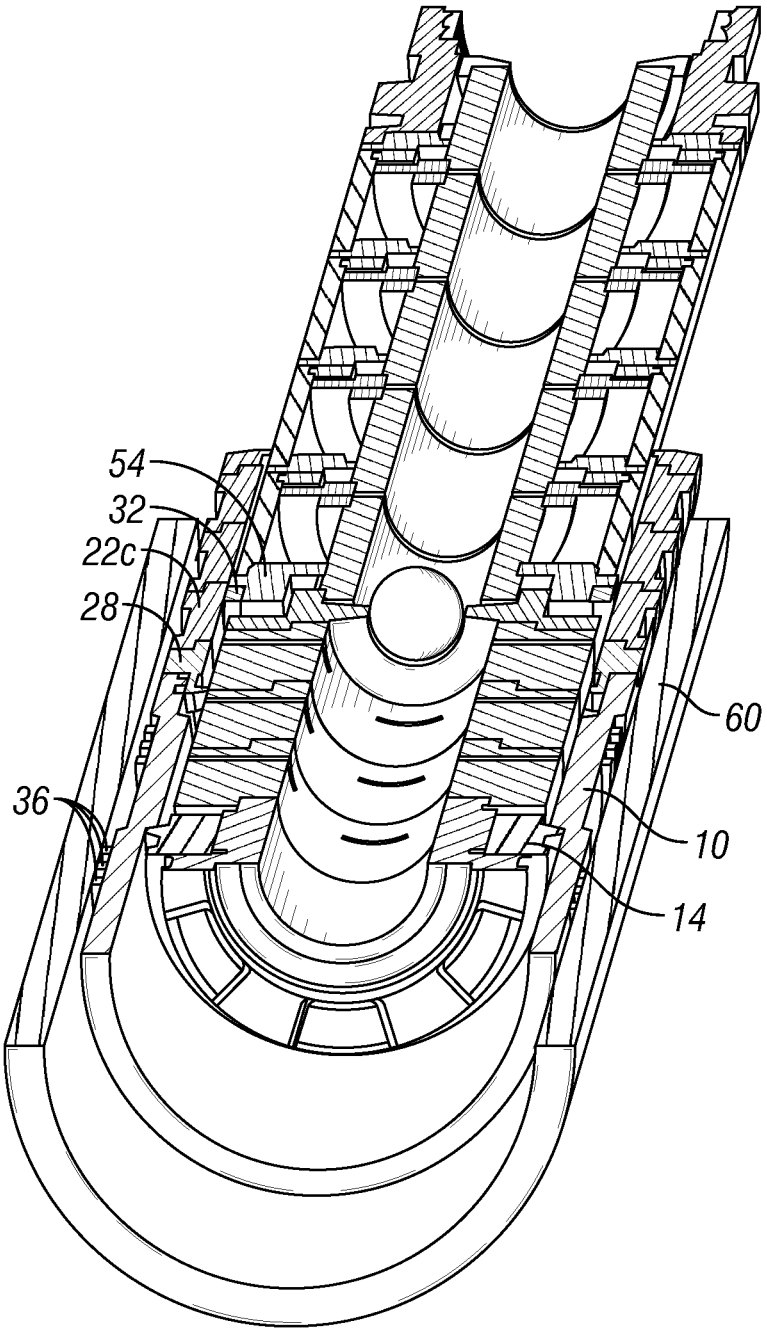
FIG. 3 is a sectioned perspective view of the expansion system shown in FIG. 1, illustrated after a first stroke of a jack actuator.
Figure 4:
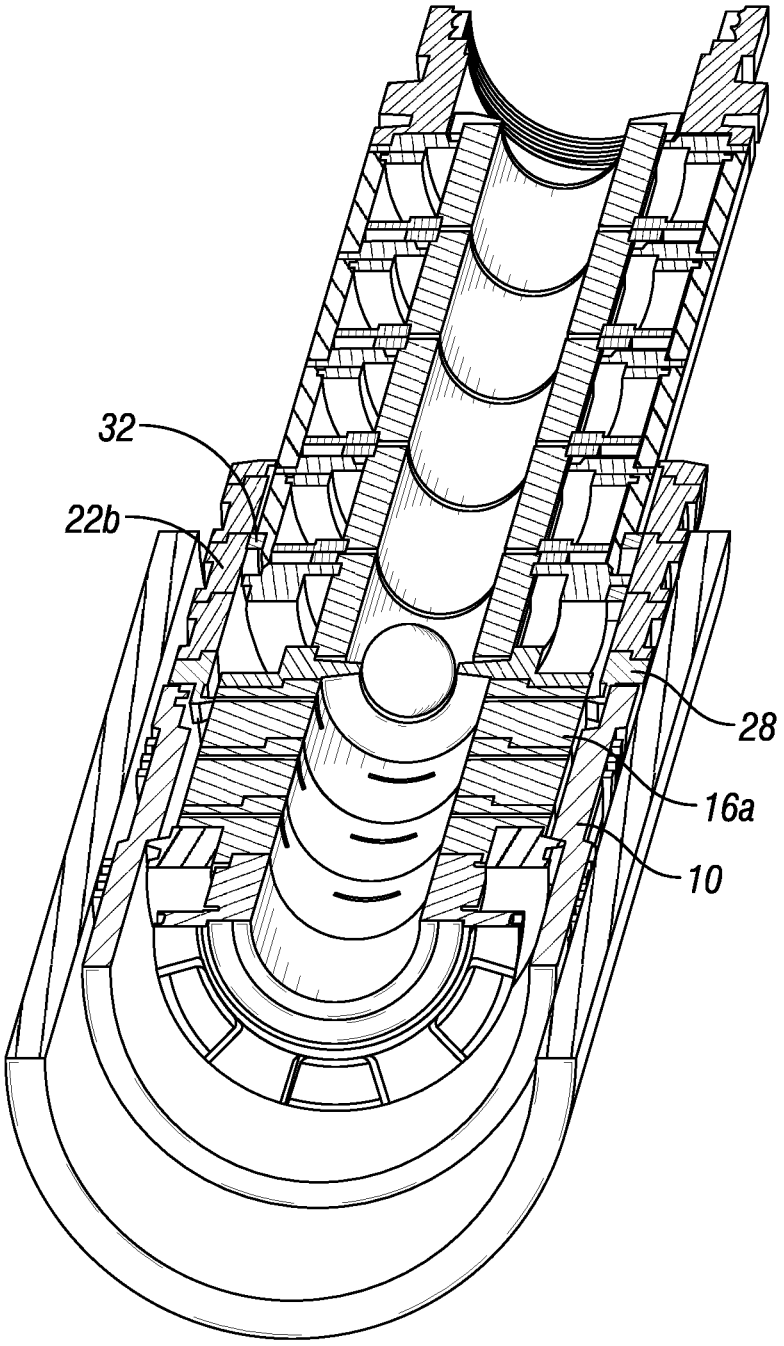
FIG. 4 is a sectioned perspective view of the expansion system shown in FIG. 1, illustrated after the jack actuator is reset.
Figure 5:
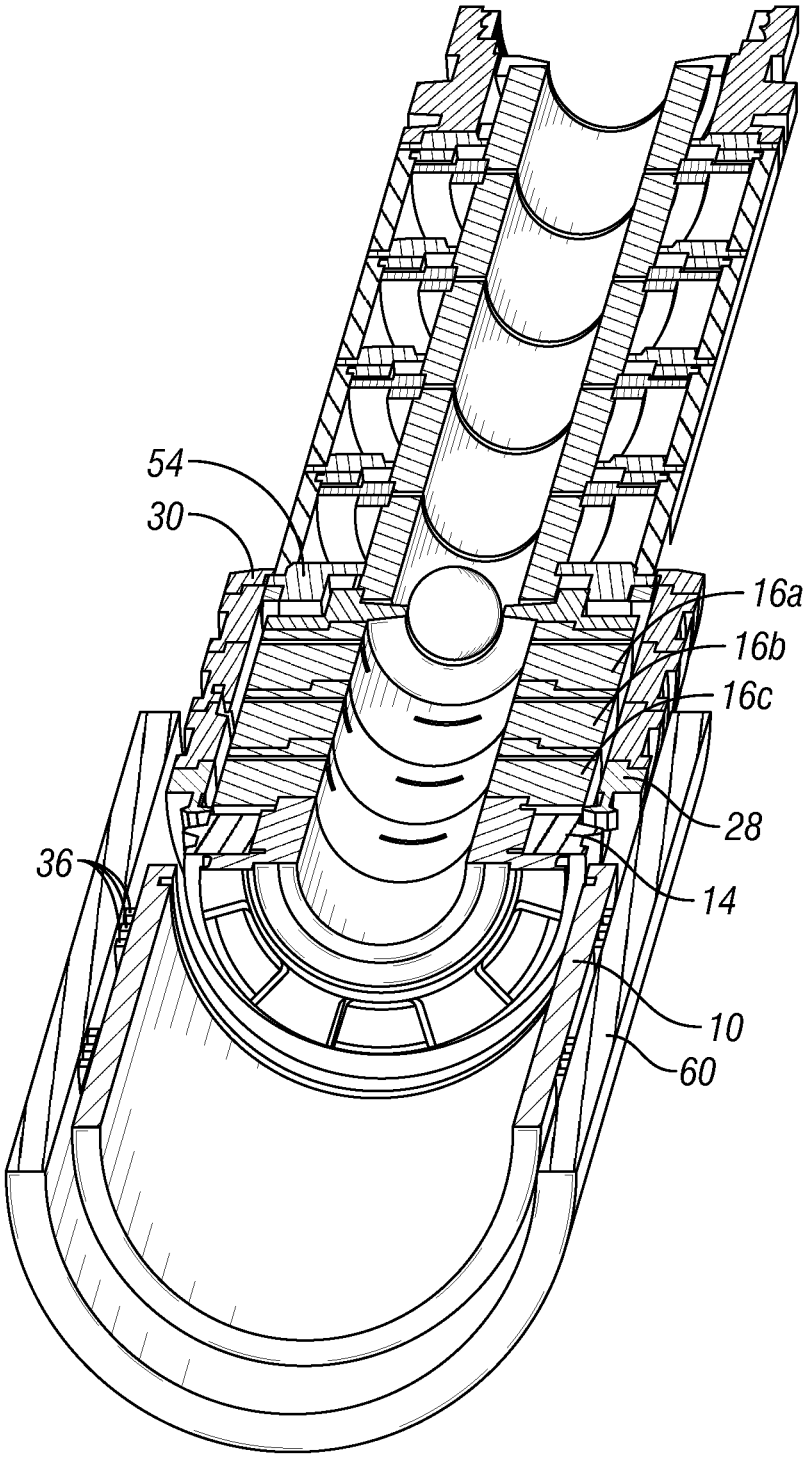
FIG. 5 is a sectioned perspective view of the expansion system shown in FIG. 1, illustrated after an operational pipe is released from an expandable tubular.

The jack actuator has an extended position, which is illustrated in FIGS. 1, 2, and 4, and a retracted position, which is illustrated in FIGS. 3, and 5. The jack actuator moves from the extended position to the retracted position by pumping fluid into the support pipe, through the bore 44 of the safety joint 46, the continuous bore 50 of the jack actuator, the inner passageways 52, and into the lower portion of each of the chambers. The fluid present in the upper portion of each of the chambers is discharged into the wellbore via the outer passageways 56. The pressure of the pumped fluid applies an upward force on each of the four pistons 38. The jack actuator can be reset to the extended position by stopping the pumping of fluid and pulling on the support pipe, the safety joint 46, the piston sleeves 42, the bottom piston sleeve 54, and the piston housings 40. The fluid present in the lower portion of each of the chambers is discharged into the continuous bore 50 via the inner passageways 52. The fluid present in the wellbore is drawn into the upper portion of each of the chambers via the outer passageways 56.

The expansion system comprises a mandrel and cone assembly. The mandrel and cone assembly is connected to a lower end of the piston assembly of the jack actuator (e.g., below the ball seat or crossover 20) such that, in operation, the jack actuator applies a force to and displaces the mandrel and cone assembly. The mandrel and cone assembly is preferably modular so that extensions can be added to accommodate a longer expandable tubular or removed to accommodate a shorter expandable tubular. Preferably, the length of each extension is similar to the stroke length of the jack actuator. Preferably, the cumulated length of all the extensions is similar to the length of the expandable tubular 10. In the example shown, the mandrel and cone assembly has three extensions.

The mandrel and cone assembly includes a mandrel connected to a cone 14. The mandrel is formed by connecting a cone mandrel 16 to three mandrel extensions 16*a*, 16*b*, 16*c*. The cone mandrel 16 is located at the lowermost end of the mandrel and is connected to the cone 14. The mandrel extension 16*a* is located at the uppermost end of the mandrel and is connected to the ball seat or crossover 20 of the piston assembly. Preferably, the mandrel has several locations where the outer diameter of the mandrel is near the inner diameter of the expandable tubular 10 in order to mitigate buckling of the expandable tubular 10 during its expansion. For example, the mandrel extensions 16*a*, 16*b*, 16*c* may each include enlarged portions or buckling arrestors. The cone 14 may be a solid cone.

The expansion system comprises an operational pipe that is releasably coupled to the top of the expandable tubular 10. The operational pipe is preferably modular so that any number of sections can be assembled to expand expandable tubulars of differing lengths. Preferably, the length of each section is similar to the stroke length of the jack actuator. Preferably, the cumulated length of all the sections is similar to the length of the expandable tubular 10. In the example shown, the operational pipe includes three sections.

The operational pipe is formed by connecting (e.g., via threaded connections) a cap 30, section 22*a*, 22*b*, 22*c*, and a releasable latch 28. The releasable latch 28 is located at a bottom end of the operational pipe. The releasable latch 28 is used to hold the operational pipe to the expandable tubular 10 until the expandable tubular 10 has fully expanded. The releasable latch 28 latches to the expandable tubular and can slide on the mandrel and cone assembly. Accordingly, the releasable latch 28 may include a lap joint 26 that fits into the top of the expandable tubular 10. The releasable latch 28 may also include a collet 34 having collet fingers. The collet fingers are supported by the mandrel and cone assembly during run-in-hole and expansion so the collet fingers cannot disengage from the expandable tubular 10. The collet 34 unlatches from the expandable tubular 10 when the cone 14 moves to a position where the enlarged portions or buckling arrestors of the mandrel extensions 16*a*, 16*b*, 16*c* no longer support the inner diameter of the collet 34, so that the collet fingers can deflect radially inward and come out of a profile machined into the top of the expandable tubular 10.

For example, in order to expand an expandable tubular shorter than the expandable tubular 10 shown in FIG. 1, one mandrel extension 16*a*, 16*b*, or 16*c* may be removed from the mandrel and cone assembly between the seat or crossover 20 and the cone 14, and by removing one section 22*a*, 22*b*, or 22*c* from the operational pipe between the cap 30 and the releasable latch 28. Conversely, in order to expand an expandable tubular longer than the expandable tubular 10 shown in FIG. 1, one mandrel extension may be added to the mandrel and cone assembly between the seat or crossover 20 and the cone 14, and one section may be added to the operational pipe between the cap 30 and the releasable latch 28.

The expansion system comprises a split-ring ratcheting lock 32 for locking the jack actuator to the operational pipe unidirectionally. Preferably, the split-ring ratcheting lock 32 remains engaged to the bottom piston sleeve 54 and can move relative to the operational pipe in the upward direction. Accordingly, the jack actuator is capable of moving toward the cap 30 of the operational pipe, for example by pulling on the jack actuator with the support pipe. In contrast, the split-ring ratcheting lock 32 is capable of resisting against the movement of the jack actuator toward the ball seat or crossover 20, for example when the jack actuator moves from the extended position toward the retracted position. Consequently, the movement of the jack actuator from the extended position toward the retracted position displaces the mandrel and cone assembly upward, while the operational pipe maintains the position of the expandable tubular 10. As such, the cone 14 can travel along the length of the expandable tubular 10 and expand the expandable tubular 10. While the embodiment illustrated in FIG. 1 shows only one split-ring ratcheting lock 32, more than one split-ring ratcheting lock may be provided on the jack actuator, for example, to increase reliability with redundancy, or to accommodate axial misalignment or tolerance build-up.

The expandable tubular 10 may optionally include a pre-expanded bottom section 12, a pre-expanded top section 24, and elastomer seals or anchor elements 36.

In the pick-up and run-in-hole position illustrated in FIG. 1, the expansion system is initially assembled with the jack actuator in the extended position at the bottom end of its stroke. The piston assembly of the jack actuator is connected to the mandrel and cone assembly. The cone mandrel 16 and mandrel extensions 16*a*, 16*b*, 16*c* are located inside the expandable tubular 10. The expandable tubular 10 is initially offset from the cone 14, that is, the lower end of the expandable tubular 10 is higher than the cone 14, so that when the operational pipe is slid around the jack actuator and starts to engage the profile machined into the releasable latch 28 at the top of the expandable tubular 10, there is no enlarged portions or buckling arrestors inside the inner diameter of the collet 34, and the collet fingers are free to bend radially inward. The lap joint 26 and the collet 34 of the releasable latch 28 are engaged on the expandable tubular 10. Once the collet 34 has engaged the expandable tubular 10, the operational pipe and the expandable tubular 10 are slid together to rest on the face of the cone 14 such that the operational pipe surrounds the jack actuator. The cone 14 may be installed in the pre-expanded bottom section 12 of the expandable tubular 10. The cone 14 supports the combined weights of the expandable tubular 10 and the operational pipe. The split-ring ratcheting lock 32 preferably aligns with an upper end of the lowermost section 22*c* of the operational pipe. Preferably, the split-ring ratcheting lock 32 aligns with and engages inner diameter threads located on top of the lowermost section 22*c* that prevent upward movement of the operational pipe and the expandable tubular 10. After the expansion system, including the operational pipe and the expandable tubular 10, is picked up, the expansion system is run-in-hole.

FIG. 2 illustrates the expansion system shown in FIG. 1 positioned in a wellbore. The expansion system may be positioned inside the base casing or open hole 60. A ball 58 is dropped to initiate the expansion of expandable tubular 10. Fluid is pumped through the support pipe, in the continuous bore 50 and in the inner passageways 52. Fluid pressure increases so that the pressure generates an upward force on the pistons 38, thereby driving the piston assembly and the mandrel and cone assembly upwards.

The piston assembly of the jack actuator moves up, pulling on mandrel and cone assembly, and the cone 14 expands the lower portion of expandable tubular 10. As the cone 14 moves up, the split-ring ratcheting lock 32, which remains engaged to the bottom piston sleeve 54, prevents upward movement of the expandable tubular 10 by applying a resisting downward force to the expandable tubular 10 via the top of the lowermost section 22*c* of the operational pipe and the releasable latch during the stroke. Accordingly, it is the split-ring ratcheting lock 32 that locks the operational pipe and the expandable tubular 10 to the housing assembly of the jack actuator. The fluid pressure is applied to stroke the piston assembly until it reaches end-of-stroke illustrated in FIG. 3. As such, a first length of the expandable tubular 10 and a first set of elastomer seals or anchor elements 36 provided on the lower end of the expandable tubular 10 are expanded. The first set of elastomer seals or anchor elements 36 engages with the base casing or open hole 60 as the expandable tubular 10 is expanded during the first stroke (or during the initial strokes if more than one stroke is needed).

Once pumping of fluid through the support pipe is stopped, the fluid pressure dissipates. The housing assembly of the jack actuator moves up by pulling on the support pipe to reset the stroke as illustrated in FIG. 4. When pulling up to reset the jack actuator, the split-ring ratcheting lock 32 is moving to a new position in the operational pipe (i.e., to the top of section 22*b*) and locks onto the next section of operational pipe (i.e., the section 22*b*). The split-ring ratcheting lock 32 aligns with and engages inner diameter threads located on top of the section 22*b*. The releasable latch 28 cannot disengage from the expandable tubular 10 while it remains supported by the enlarged portion or buckling arrestor provided on the mandrel extension 16*a*. Thus, the releasable latch 28 continues latching the operational pipe to the expandable tubular 10 while the jack actuator is being reset.

In the example shown, the process of applying fluid pressure to stroke the jack actuator and pulling on the support pipe to reset the jack actuator is repeated for a second and a third stroke until the cone 14 enters the pre-expanded top section 24 of the expandable tubular after having expanded a second set of elastomer seals or anchor elements 36 located at the upper end of the expandable tubular. However, fewer or more than three strokes may be needed to expand the expandable tubular 10 depending on the length of the expandable tubular. The number of strokes is preferably equal to the number of sections in the operational pipe and/or the number of extensions in the mandrel and cone assembly; however, it does not need to be equal, provided that the locations of the inner diameter threads on the sections of the operational pipe are rearranged accordingly.

FIG. 5 illustrates the expansion system shown in FIG. 1 after final jack stroke and after the releasable latch 28 is disengaged from expandable tubular 10. The second set of elastomer seals or anchor elements 36 is engaged with the base casing or open hole 60 as expandable tubular 10 is expanded during the last stroke (or during the final strokes if more than one stroke is needed). After all the enlarged portions or buckling arrestors provided on the mandrel extensions 16*a*, 16*b*, 16*c* have moved past the releasable latch 28, the releasable latch 28 is now free to disengage from expandable tubular 10, because an unsupported section located between the mandrel extension 16*c* and the cone 14 allows for unlatching the operational pipe from expandable tubular 10. Moderate pressure is preferably maintained while pulling up the support pipe to unlatch the releasable latch 28 from the expandable tubular 10. The cap 30 has a shoulder to carry the operational pipe to the surface after it is unlatched from expandable tubular 10. The bottom piston sleeve 54 has a shoulder to catch on the cap 30 at the top of the operational pipe, and the operational pipe is hanging from the jack actuator at this shoulder.

At this point, the jack actuator, the mandrel and cone assembly, and the operational pipe can all be pulled out of the hole, leaving the expandable tubular in the base casing or open hole 60.

Figure 6:
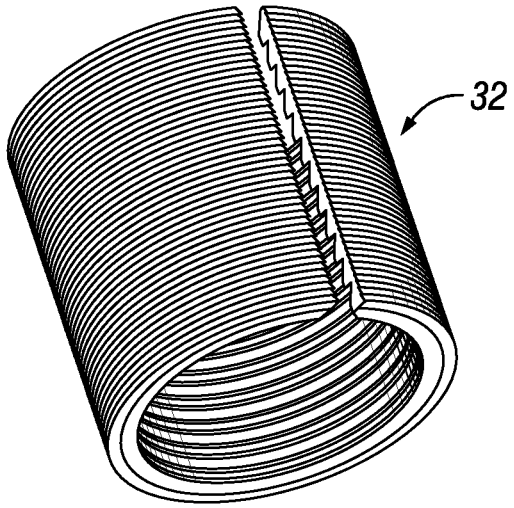
FIG. 6 is a perspective view of split-ring ratcheting lock used to unidirectionally lock a jack actuator to an operational pipe in the expansion system shown in FIG. 1.

FIG. 6 illustrates that the split-ring ratcheting lock 32 has an internal thread that is preferably a coarse buttress thread and an external thread that is preferably a fine ratchet thread.

Figure 7:
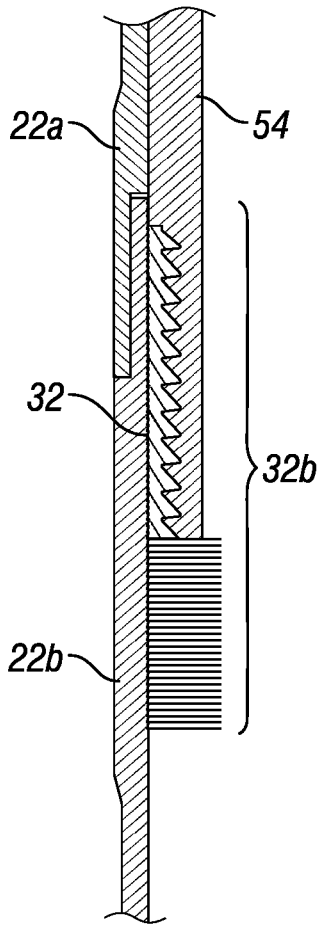
FIG. 7 is a partial sectional view of the split-ring ratcheting lock shown in FIG. 6, illustrated with the jack actuator and the operational pipe.

FIG. 7 illustrates that the bottom piston sleeve 54 has an external thread that is a coarse buttress thread configured to remain engaged with the internal thread of the split-ring ratcheting lock 32. Further, the top of each section of the operational pipe has an internal thread that is a fine ratchet thread configured to lock unidirectionally with the external thread of the split-ring ratcheting lock 32. For example, the top of section 22*b* has an internal thread 32*b* that is a fine ratchet thread configured to lock unidirectionally with the external thread of the split-ring ratcheting lock 32. The bottom piston sleeve 54 drives the split-ring ratcheting lock 32, and can move upward past the internal threads but may be locked when attempting to move downward past the internal threads.

In use, an operator may measure the length of the expandable tubular 10. Based on the measured length, the operator may determine the number of sections 22*a*, etc., to form an operational pipe that has a sufficient length to expand the expandable tubular 10. The operator may also determine the number of extensions 16*a*, etc., to form the mandrel and cone assembly that has a sufficient length to expand the expandable tubular. Besides, the operator may optionally determine a force magnitude necessary to expand the expandable tubular 10, and a fluid pressure available at the wellbore to expand the expandable tubular. The operator may determine the number of stages of the jack actuator to achieve the necessary force magnitude with the available fluid pressure. An expansion system including the jack actuator, the operational pipe, the mandrel and cone assembly, and a split-ring ratcheting lock 32 is then assembled.

The expandable tubular is then expanded inside the base casing or open hole 60 by repeatedly stroking the jack actuator. The split-ring ratcheting lock 32 is a unidirectional locking mechanism stationary relative to the actuator and unidirectionally movable relative to the operational pipe (vice-versa). Accordingly, when the jack actuator is pulled by the support pipe, the split-ring ratcheting lock 32 moves up in the operational pipe. Pulling on the support pipe can be used to extend the jack actuator. However, when the jack actuator retracts by pumping fluid into the support pipe, the split-ring ratcheting lock 32 does not move down in the operational pipe. Instead, the cone 14 expands a portion of the expandable tubular 10.

When the expandable tubular 10 is expanded, the releasable latch 28 contracts within the unsupported section located between the cone 14 and the extensions 16*a*, etc., thereby allowing the releasable latch 28 to decouple from the expandable tubular 10. The shoulder in the cap 30 catches the shoulder of the bottom piston sleeve 54. Accordingly, the operational pipe hangs from the jack actuator and can be retrieved to the surface with the support pipe, leaving only the expandable tubular 10 in the wellbore. When the expandable tubular 10 has no shoe or plug, the wellbore remains unobstructed.

While it may be convenient that the split-ring ratcheting lock 32 remains stationary relative to the jack actuator, that is, in the example shown, to the bottom piston sleeve 54, and that the split-ring ratcheting lock 32 is unidirectionally slidable/lockable relative to the operational pipe, that is, in the example shown, to the top of each section 22*a*, 22*b*, 22*c*, the split-ring ratcheting lock 32 may alternatively remain stationary relative to the operational pipe and unidirectionally slidable/lockable relative to the jack actuator (e.g., to the housing assembly of the jack actuator). For example, it may be preferable to machine long sections of fine ratchet threads externally. In such a case, the split-ring ratcheting lock 32 can be configured to remain engaged to the cap 30 of the operational pipe via coarse buttress threads. Further, external fine threads can be provided on the outer diameter of the piston housings 40 or, if the jack actuator is shorter than the operational pipe (e.g., the jack actuator has fewer stages than shown in FIGS. 1-5) on one or more extension collars mounted on top of the jack actuator.

In other embodiments, the expansion system may be lowered in the wellbore using coil tubing or wireline instead of the support pipe. If using wireline, the jack actuator could be powered using pressurized fluid provided by an electric downhole pump, for example.

Specific embodiments of the invention are shown by way of example in the drawings and description. The embodiments are susceptible to various modifications and alternative forms known to a person having ordinary skill in the art. Thus, it should be understood that the drawings and detailed description thereto are not intended to limit the claims to the particular form disclosed, but on the contrary, the intention is to cover all modifications, equivalents, and alternatives falling within the scope of the disclosure.

What is claimed is:

1. An expansion system for expanding an expandable tubular, comprising:

an actuator;

an operational pipe that includes a plurality of sections;

a mandrel and cone assembly that includes a plurality of extensions; and a unidirectional locking mechanism stationary relative to one of the actuator or the operational pipe and unidirectionally movable relative to the other of the actuator and the operational pipe, wherein the actuator is modular and includes a plurality of stages.

2. The expansion system of claim 1, wherein the unidirectional locking mechanism includes a split-ring ratcheting lock configured to releasably engage and unidirectionally lock to inner threads on the plurality of sections of the operational pipe.

3. The expansion system of claim 1, wherein the expandable tubular has no shoe or plug.

4. The expansion system of claim 1, wherein the operational pipe includes a releasable latch located at the bottom of the operational pipe and coupled to the expandable tubular.

5. The expansion system of claim 4, wherein the mandrel and cone assembly includes enlarged portions or buckling arrestors on each of the plurality of extensions and an unsupported section above the cone, wherein the enlarged portions or buckling arrestors are sized to extend the releasable latch radially and prevent the releasable latch from decoupling from the expandable tubular, and wherein the unsupported section is sized to allow the releasable latch to contract radially and decouple from the expandable tubular.

6. An expansion system for expanding an expandable tubular, comprising:

an actuator;

an operational pipe that includes a plurality of sections;

a mandrel and cone assembly that includes a plurality of extensions; and a unidirectional locking mechanism stationary relative to one of the actuator or the operational pipe and unidirectionally movable relative to the other of the actuator and the operational pipe, wherein the operational pipe includes a releasable latch located at the bottom of the operational pipe and coupled to the expandable tubular, wherein the mandrel and cone assembly includes enlarged portions or buckling arrestors on each of the plurality of extensions and an unsupported section above the cone, wherein the enlarged portions or buckling arrestors are sized to extend the releasable latch radially and prevent the releasable latch from decoupling from the expandable tubular, and wherein the unsupported section is sized to allow the releasable latch to contract radially and decouple from the expandable tubular.

7. The expansion system of claim 6, wherein the expandable tubular has no shoe or plug.

8. The expansion system of claim 6, wherein the operational pipe includes a cap, the cap having a shoulder, and wherein the actuator includes a bottom shoulder capable of catching the shoulder of the cap.

9. A method for expanding an expandable tubular, comprising:

measuring a length of the expandable tubular;

determining a first number of sections to form an operational pipe based on the measured length;

determining a second number of extensions to form a mandrel and cone assembly based on the measured length;

determining a force magnitude to expand the expandable tubular;

determining a fluid pressure to expand the expandable tubular;

determining a third number of stages to achieve the force magnitude with the fluid pressure;

forming an actuator with the third number of stages;

assembling an expansion system including:

the actuator;

the operational pipe formed with the first number of sections;

the mandrel and cone assembly formed with the second number of extensions; and a unidirectional locking mechanism stationary relative to one of the actuator or the operational pipe and unidirectionally movable relative to the other of the actuator and the operational pipe; and expanding the expandable tubular with the expansion system.

10. The method of claim 9, wherein the unidirectional locking mechanism includes a split-ring ratcheting lock configured to releasably engage and unidirectionally lock to inner threads on the plurality of sections of the operational pipe.

11. The method of claim 9, wherein the operational pipe includes a cap, the cap having a shoulder, and wherein the actuator includes a bottom shoulder, the method further comprising:

catching the cap with the bottom shoulder to hang the operational pipe from the actuator.

12. The method claim 9, comprising:

stroking the actuator repeatedly;

engaging the unidirectional locking mechanism to the operational pipe during a stroke of the actuator; and moving the unidirectional locking mechanism relative to the operational pipe during a reverse stroke of the actuator.

13. The method of claim 9, wherein the operational pipe includes a releasable latch located at the bottom of the operational pipe and coupled to the expandable tubular, wherein the mandrel and cone assembly includes enlarged portions or buckling arrestors on each of the plurality of extensions and an unsupported section above the cone, the method further comprising:

extending the releasable latch with the enlarged portions or buckling arrestors to prevent the releasable latch from decoupling from the expandable tubular; and contracting the releasable latch within the unsupported section to allow the releasable latch to decouple from the expandable tubular.

14. The method of claim 9, wherein the expandable tubular has no shoe or plug.

15. A method for expanding an expandable tubular, comprising:

measuring a length of the expandable tubular;

determining a first number of sections to form an operational pipe based on the measured length;

determining a second number of extensions to form a mandrel and cone assembly based on the measured length;

assembling an expansion system including:

an actuator;

the operational pipe formed with the first number of sections;

the mandrel and cone assembly formed with the second number of extensions; and a unidirectional locking mechanism stationary relative to one of the actuator or the operational pipe and unidirectionally movable relative to the other of the actuator and the operational pipe;

wherein the operational pipe includes a releasable latch located at the bottom of the operational pipe and coupled to the expandable tubular, wherein the mandrel and cone assembly includes enlarged portions or buckling arrestors on each of the plurality of extensions and an unsupported section above the cone, extending the releasable latch with the enlarged portions or buckling arrestors to prevent the releasable latch from decoupling from the expandable tubular;

expanding the expandable tubular with the expansion system; and contracting the releasable latch within the unsupported section to allow the releasable latch to decouple from the expandable tubular.

16. The method of claim 15, wherein the expandable tubular has no shoe or plug.

17. The method of claim 15, wherein the operational pipe includes a cap, the cap having a shoulder, and wherein the actuator includes a bottom shoulder, the method further comprising:

catching the cap with the bottom shoulder to hang the operational pipe from the actuator.

18. The method of claim 15, comprising:

stroking the actuator repeatedly;

engaging the unidirectional locking mechanism to the operational pipe during a stroke of the actuator; and moving the unidirectional locking mechanism relative to the operational pipe during a reverse stroke of the actuator.

* * * * *